US008574025B2

(12) United States Patent
Kent

(10) Patent No.: US 8,574,025 B2
(45) Date of Patent: Nov. 5, 2013

(54) BODY SLIMMER

(76) Inventor: Margi Kent, Los Angeles, CA (US)

( * ) Notice: Subject to any disclaimer, the term of this patent is extended or adjusted under 35 U.S.C. 154(b) by 339 days.

(21) Appl. No.: 13/033,348

(22) Filed: Feb. 23, 2011

(65) Prior Publication Data

US 2011/0207382 A1 Aug. 25, 2011

Related U.S. Application Data

(60) Provisional application No. 61/307,199, filed on Feb. 23, 2010.

(51) Int. Cl.
*A41C 1/06* (2006.01)

(52) U.S. Cl.
USPC ..... 450/7; 450/19; 450/20; 2/78.3

(58) Field of Classification Search
USPC ..... 450/7–11, 97–99, 107, 115–118, 122, 450/124, 126–128, 134–140, 19, 20; 2/78.1, 73
See application file for complete search history.

(56) References Cited

U.S. PATENT DOCUMENTS 4,095,291 A * 6/1978 Di Tullio ..... 2/67
4,538,615 A * 9/1985 Pundyk ..... 450/131
6,000,993 A * 12/1999 Erwin ..... 450/7
6,113,460 A * 9/2000 McKeown ..... 450/31
6,298,486 B1 * 10/2001 Huang ..... 2/78.1

OTHER PUBLICATIONS

The International Serach Report and The Written Opinion of the International Searching Authority for International Application No. PCT/2011/025902, filed Feb. 23, 2011, dated Apr. 12, 2011; 6 Pages.

* cited by examiner

*Primary Examiner* — Gloria Hale
(74) *Attorney, Agent, or Firm* — Christie, Parker & Hale, LLP

(57) ABSTRACT

A stretchable undergarment comprises a one-piece body slimming unit made of front and rear panels cut and sewn along the edges to form a tubular body shaping garment construction which is stretchable in the longitudinal direction, and having a lightweight zippered opening along the front. The undergarment is made from a woven stretchable satin material containing a small amount of thin spandex-type elastic fibers forming a predominately one-way vertical stretch in a base textile fabric made from thin polymeric textile fibers such as nylon.

19 Claims, 2 Drawing Sheets

BODY SLIMMER

CROSS-REFERENCE TO RELATED APPLICATION

This application claims priority to U.S. Provisional Application No. 61/307,199, filed Feb. 23, 2010, the contents of which are fully incorporated herein by reference.

FIELD OF THE INVENTION

This invention relates to undergarments, and more particularly, to a foundation undergarment having a body slimming function.

BACKGROUND

Certain fashion designers, especially those who create custom dress designs worn by female celebrities, often require use of a stretchable body-shaping undergarment. Some stretchable body shaping materials can be sewn into the inside of the outer garment or dress. The present invention has to do with a stand-alone body slimming foundation undergarment worn independently of the outer garment or dress.

Foundation undergarments, commonly referred to as body shapers, bodysuits or "shapewear," are typically made from stretchable fabrics containing spandex or Lycra, for example. They typically firm the user's body shape underneath the outer dress or similar apparel.

These stretchable foundation undergarments should produce a smooth fit that flatters the figure while maintaining long-term comfort. However, some of these prior art foundation undergarments, while stretchable, are not effective in producing a body slimming function. They may "hold you in" but not make you look slimmer.

SUMMARY OF THE INVENTION

Briefly, one embodiment of this invention comprises a stretchable body slimming foundation undergarment comprising a front panel of a stretchable fabric, and a rear panel of a stretchable fabric. The two panels are cut-and-sewn to form a one-piece undergarment with a U-shaped, scoop neck opening in the front extending to an opening in the back to form a pair of narrow left and right shoulder straps on opposite sides of the undergarment. The undergarment extends down to form generally tubular left and right leg sections each extending to a region above the knees of the user.

The foundation undergarment further includes a zipper opening extending vertically along the front of the undergarment from the crotch region up to the base of the U-shaped front opening.

The front and rear panels have a predominately one-way stretch in a longitudinal direction. The front and rear panels are made from a stretchable warp-effect satin weave material containing a minor portion of thin filament, synthetic polymer elastic fibers woven into a base textile material made from synthetic polymeric fibers, such as nylon, the stretchable material having a weight from about 6.5 to about 9.5 oz/yd$^2$, and more preferably about 7.0 to about 9.0 oz/yd$^2$.

The front and rear panels are preferably cut by cutting all edges in the cross-grain direction.

A presently preferred elastic synthetic fiber material contained in the stretchable satin fabric is spandex, a polyurethane-polyurea copolymer which is the common generic name for the desired elastic fiber material. LYCRA, which is the brand name of the spandex material, is made by Invista, previously DuPont, and is one of the spandex materials that can be used. The elastic synthetic fibers are preferably thin fibers of approximately 100 to 200 denier.

A preferred stretchable fabric contains from about 8 to about 12% spandex fibers woven in a satin weave with thin nylon fibers to produce a stretchable fabric having a weight of about 8 oz/yd$^2$.

The present invention provides a body slimming undergarment which is surprisingly smooth in its support and also comfortable when worn—while it firmly takes in the wearer's body shape sufficiently that the user appears to be slimmer by one dress size or more.

The invention's unique function is visually demonstrated when comparing "before and after" views of a user who wears the same designer dress both without and with the body slimmer. A user wearing the same dress can have an apparent reduction of at least one dress size when wearing the body slimming undergarment of this invention.

These and other aspects of the invention will be more fully understood by referring to the following detailed description and the accompanying drawings.

DETAILED DESCRIPTION

Figure 1:
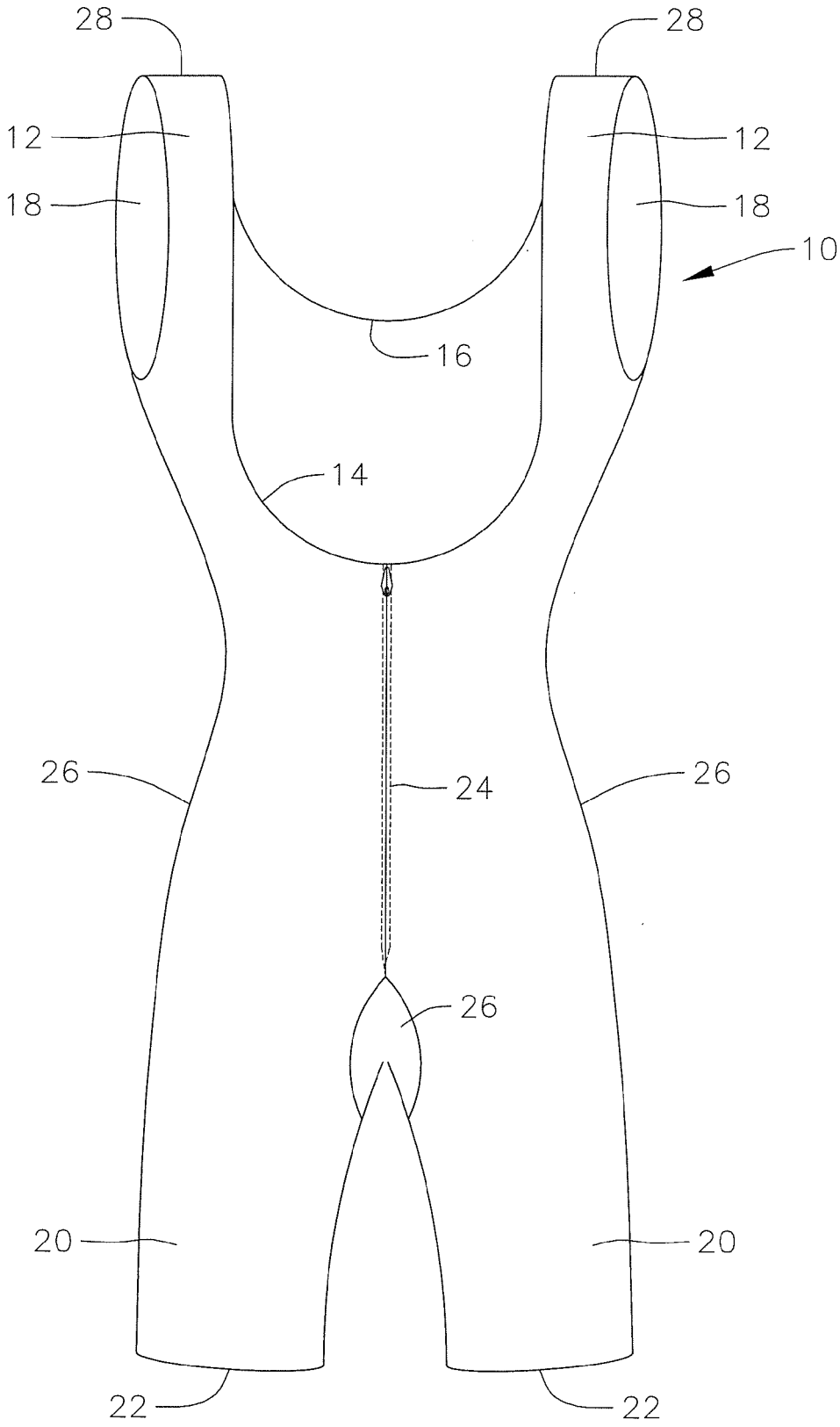
FIG. 1 is a semi-schematic front elevational view showing one embodiment of a body slimming foundation undergarment according to this invention.

FIG. 1 illustrates one embodiment of a stretchable foundation undergarment 10 according to principles of this invention. The undergarment comprises a one-piece body slimming unit made of front and rear panels cut and sewn along the edges to form a tubular upper torso body construction with a pair of lower leg sections. The foundation undergarment has a configuration that matches the female body shape and has a tank-style upper opening with front and rear scoop neck openings between left and right shoulder straps. The particular configuration of the garment can vary without departing from the scope of the invention. In one form of the present invention, the undergarment can vary in its configuration to match three different body types with at least six sizes for each.

In the embodiment of FIG. 1, narrow elongated left and right shoulder straps 12 are on opposite sides of a tank-style scoop neck top opening for the user's head and upper torso. This forms a U-shaped front opening 14 between the front sides of the two shoulder straps and a U-shaped opening 16 for the back region extending between the rear sides of the shoulder straps. The U-shaped front opening 14 has a greater depth than the rear U-shaped opening 16. The front U-shaped opening 14 is sized to fit under the user's bra, the opening having a lower edge extending across the front panel below the bra region of the user. Left and right side openings 18 for the user's arms are cut along the left and right sides of the garment to form the outer configuration of the shoulder straps.

The side edges of the garment are taken in at the waist region and then extend down to form a pair of generally tubular left and right short leg sections 20 each extending below the crotch region of the garment. Left and right leg openings 22 are cut at the bottom of the leg sections so that each of the leg sections extends along the thighs and terminates short of the knees and does not extend below the knees.

A zipper 24 extends axially along the front center portion of the garment, from the bottom of the front opening 14 to just above the front crotch region of the garment. The front opening formed by the zipper is the only adjustable and enlargeable opening in the undergarment. There is no rear zippered opening, for example. The crotch region of the finished undergarment can contain separate layers of material, such as double overlapping layers 25 of a cotton blend fabric, for example. The rest of undergarment is of one-piece construction.

The undergarment is preferably made from two separate layers of a stretchable satin fabric in flat form, overlaid to form the front and rear panels of the undergarment, and sewn together along the outer edges to form the one-piece unit.

The undergarment is preferably made from a thin, flexible, stretchable fabric by cut-and-sew techniques. The stretchable fabric generally contains a small percentage of thin lightweight elastic synthetic fibers. A preferred elastic fiber is one made of long chain polyurethane fibers. The presently preferred stretchable fibers used in the fabric are made of spandex fibers, such as LYCRA spandex fibers.

The desired fabric contains a greater percentage of a basic textile fabric. Synthetic fibers, preferably nylon, comprise the basic predominant textile fabric material.

A preferred stretchable fabric material is made with a satin weave and is stretchable predominantly in one direction. A satin material having at least 90% of its overall stretch in one direction is preferred.

A presently preferred stretchable material has a warp-effect satin weave and is made from a small percentage of spandex fibers contained in a major percentage of woven nylon fibers. The preferred material has a weight measured in ounces per square yard from 6.5 up to no more than about 9.5. In one embodiment, the weight range is about 7.0 to about 9.0 oz/yd$^2$. Best results are achieved in this weight range in terms of the body slimming function and comfort. A presently preferred material which has produced good results has a weight of about 8 oz/yd$^2$ and has a satin weave made from 90% 40 denier semi-dull nylon and 10% 140 denier spandex, product number 4110 from Darlington Fabrics Corporation. The presently preferred Darlington 4110 material is characterized by the manufacturer as a satin warp-knit elastic fabric comprising the identified blend of nylon and spandex. The Darlington 4110 material includes a moisture-management finish known as Naturexx which wicks away moisture from the skin to keep the wearer cool and dry.

A lighter weight satin stretch material weighing about 6.5 oz/yd$^2$ would be a minimum weight of the material used in the undergarment. Such a material is available under product number 4120 from Darlington, a satin warp-knit elastic fabric referred to as a satin weave containing 65% 40 denier ext. brt. nylon, 25% 30 denier ext. brt. nylon, and 10% 105 denier spandex. This material also preferably contains the Naturexx finish.

A heavier stretchable material weighing 9.9 oz/yd$^2$ would exceed the desired maximum weight of the stretchable material. Such a material is available under product number 8050 from Darlington, a satin warp-knit elastic fabric referred to as a brt. heavy wt. Raschel, 66% 70 denier brt. nylon, 24% 40 denier semi-dull nylon, and 10% 280 denier spandex. A weight of satin spandex of about 9.5 oz/yd$^2$ produces a body slimming function with borderline comfort.

The zippered closure in front of the garment is a lightweight, knitted, tape zipper or an invisible tape zipper. The zipper length can be 14 inches (small), 16 inches (medium), or 18 inches (large).

A preferred zipper material is available as product number 580 from YKK Group. The invisible tape zipper from YKK is available under product code number 66413. A preferred zipper material is a non-metal, plastic coil zipper with no visible zipper teeth. A preferred non-invisible tape zipper is available from YKK under product code number 40431.

The garment is made from two overlapping panels by a cut-and-sew technique. The two panels are made by laser cutting along the edges. The laser cutting steps are made cross-grain. The two panels are cut so the one-way stretch direction of each fabric panel is in the axial (vertical) direction. The two overlaid panels are positioned with matte on the inside and bright on the outside. They are sewn together along virtually invisible seams 26 along the sides, and seams 28 along the top of the shoulder straps. The resulting undergarment has a one-way stretch in a lengthwise direction, front and back.

Figure 2:
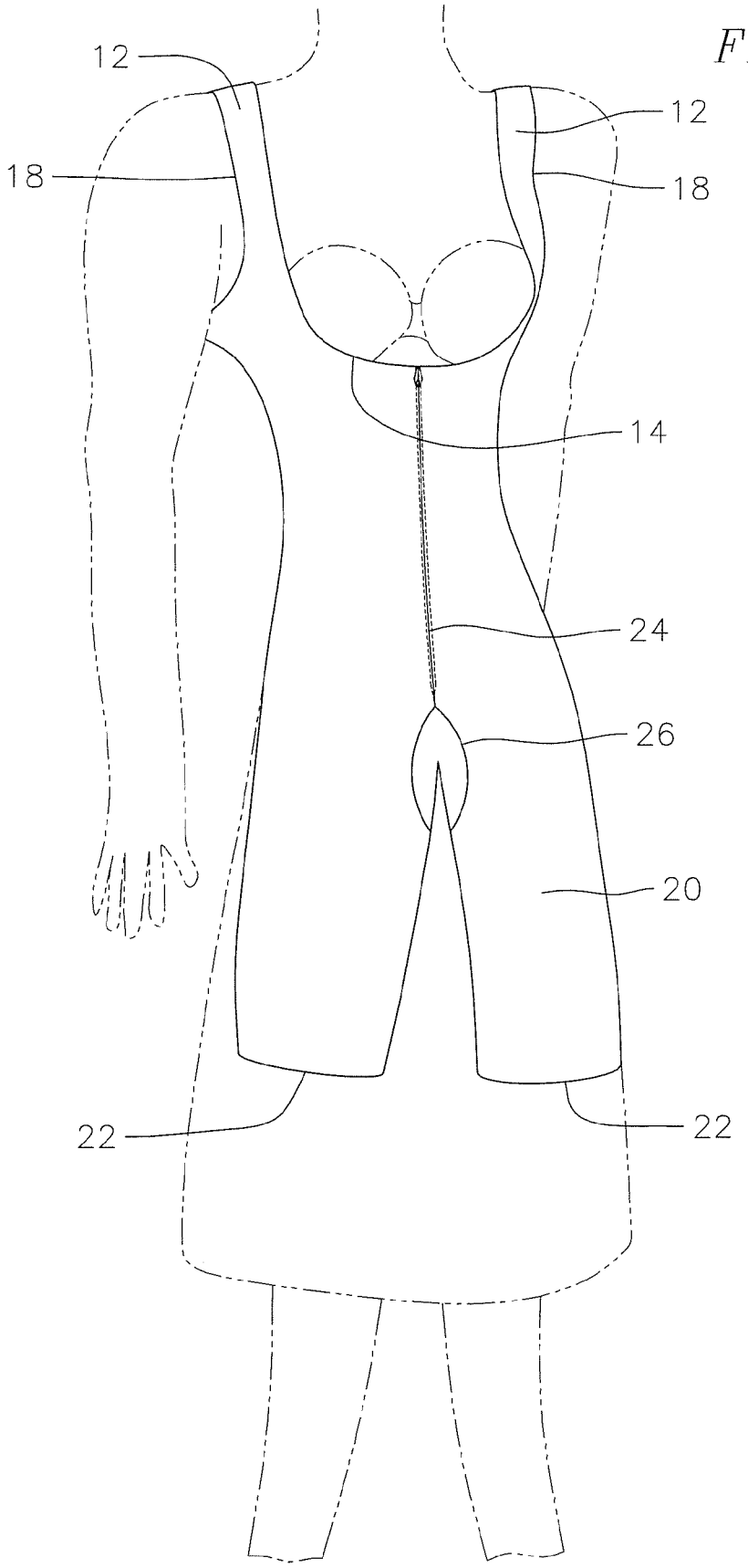
FIG. 2 is a semi-schematic perspective view showing the foundation undergarment of FIG. 1 in use.

FIG. 2 shows the body slimming undergarment in use. As can be seen, the U-shaped front opening 14 extends down sufficiently to fit under the user's bra. The user and the outer dress are shown in phantom lines.

What is claimed is:

1. A stretchable undergarment comprising front and rear panels cut and sewn to form a one-piece body slimming unit comprising a generally tubular upper section for the upper torso continuous with generally tubular leg sections for the left and right legs of the wearer, the tubular upper section having a front side, a rear side, and left and right sides, the leg sections elongated for extending along the thighs and terminating near the knees of the wearer, the upper section having a top opening forming left and right shoulder straps atop the upper section, the front and rear panels made from a stretchable satin warp-knit elastic material predominately containing a thin polymeric textile fabric base material and a minor amount of spandex blended with the textile fabric base material and forming a predominately one-way stretch material that forms substantially the entire front, rear, and left and right sides of the upper section and the left and right leg sections of the undergarment, the undergarment, when worn by the wearer, having a one-way stretch substantially entirely in the longitudinal direction extending continuously along substantially the entire front and rear sides, the left and right sides, and the tubular left and right leg sections of the undergarment.

2. The undergarment according to claim 1 in which the thin polymeric textile fiber base material comprises nylon.

3. The undergarment according to claim 1 which is cut in the cross-grain direction along the left and right sides of the upper section and along opposite sides of the left and right leg sections, and including invisible vertical seams along the left and right sides of the upper section and along the opposite sides of the leg sections of the undergarment.

4. The undergarment according to claim 1 in which the stretchable material contains 100-200 denier spandex.

5. The undergarment according to claim 4 in which the stretchable undergarment material comprises 30 to 40 denier nylon.

6. The undergarment according to claim 1 in which the stretchable material contains 8-12% spandex.

7. The undergarment according to claim 1 in which the top opening has a lower edge extending across the front panel below a bra section of the wearer.

8. The undergarment according to claim 1 in which the stretchable material has at least 90% of its overall stretch in one direction.

9. The undergarment according to claim 1 including a zippered opening along the front of the upper section.

10. The undergarment according to claim 1 in which the stretchable material has a weight from about 6.5 to about 9.5 oz./yd$^2$.

11. The undergarment according to claim 1 in which the stretchable material has a weight below about 9.5 oz./yd$^2$.

12. The undergarment according to claim 1 in which the tubular upper section is cut and sewn to extend under the arms of the user and around the back of the user's upper torso.

13. A stretchable body slimming undergarment comprising front and rear panels cut and sewn to form a one-piece body slimming unit comprising a generally tubular upper section for the upper torso continuous with generally tubular leg sections for the left and right legs of the wearer, the tubular upper section having a front side, a rear side, and left and right sides, the leg sections elongated for extending along the thighs and terminating near the knees of the wearer, the upper section having a top opening forming left and right shoulder straps atop the upper section, the front and rear panels made from a stretchable satin warp-knit elastic material predominately containing a thin polymeric textile fabric base material and a minor amount of spandex blended into the textile fabric base material and forming a predominately one-way stretch material that forms substantially the entire front, rear, and left and right sides of the upper section and the left and right leg sections of the undergarment, the undergarment, when worn by the wearer, having a one-way stretch substantially entirely in the longitudinal direction extending continuously along substantially the entire front and rear sides, the left and right sides, and the tubular left and right leg sections of the undergarment;

the stretchable material having a weight from about 6.5 to about 9.5 oz./yd$^2$, in which the thin polymeric textile fiber base material comprises nylon, and in which the stretchable material comprises from about 8% to about 12%, 100 to 200 denier spandex.

14. The undergarment according to claim 13 in which the top opening has a lower edge extending across the front panel below a bra section of the wearer.

15. The undergarment according to claim 13 in which the stretchable material has at least 90% of its overall stretch in one direction.

16. The undergarment according to claim 13 including a zippered opening along the front of the upper section.

17. The undergarment according to claim 13 in which the tubular upper section is cut and sewn to extend under the arms of the user and around the back of the user's upper torso.

18. The undergarment according to claim 1 in which the stretchable undergarment material comprises 30 to 40 denier nylon.

19. The undergarment according to claim 13 in which the stretchable undergarment material comprises 30 to 40 denier nylon.

* * * * *